US010750813B2

(12) United States Patent
Hayes et al.

(10) Patent No.: US 10,750,813 B2
(45) **Date of Patent: *Aug. 25, 2020**

(54) LOCKING MIDSOLE AND INSOLE ASSEMBLY

(71) Applicant: Superfeet Worldwide, Inc., Ferndale, WA (US)

(72) Inventors: Eric Paris Hayes, Ferndale, WA (US); Matthew Warren Gooch, Ferndale, WA (US); Daniel Wakeland, Bellingham, WA (US)

(73) Assignee: SUPERFEET WORLDWIDE, INC., Ferndale, WA (US)

( * ) Notice: Subject to any disclaimer, the term of this patent is extended or adjusted under 35 U.S.C. 154(b) by 50 days.

This patent is subject to a terminal disclaimer.

(21) Appl. No.: 16/174,875

(22) Filed: Oct. 30, 2018

(65) Prior Publication Data

US 2019/0069629 A1 Mar. 7, 2019

Related U.S. Application Data

(63) Continuation of application No. 15/226,838, filed on Aug. 2, 2016, now Pat. No. 10,172,414.

(51) Int. Cl.
*A43B 13/12* (2006.01)
*A43B 9/00* (2006.01)
(Continued)

(52) U.S. Cl.
CPC ..... *A43B 9/00* (2013.01); *A43B 7/14* (2013.01); *A43B 13/023* (2013.01); *A43B 13/12* (2013.01);
(Continued)

(58) Field of Classification Search
CPC ..... A43B 1/06; A43B 7/24; A43B 13/023; A43B 13/12; A43B 13/127; A43B 17/00
(Continued)

(56) References Cited

U.S. PATENT DOCUMENTS 6,038,790 A 3/2000 Pyle et al.
6,092,311 A 7/2000 MacNamara
(Continued)

FOREIGN PATENT DOCUMENTS

DE 102013007450 A1 7/2014
EP 2057913 A1 5/2009

OTHER PUBLICATIONS

PCT; International Search Report and Written Opinion; dated Jun. 21, 2018; 3 pages, all pages pertinent.
(Continued)

*Primary Examiner* — Marie D Bays
(74) *Attorney, Agent, or Firm* — Lowe Graham Jones PLLC

(57) ABSTRACT

A footwear item includes an insole, an outsole, and a midsole. The insole includes an insole top surface, an insole bottom surface, and an insole sidewall. The outsole includes an outsole top surface and an outsole bottom surface. The midsole is positioned between the insole and the outsole. The midsole is configured to nest onto the top surface of the outsole. In at least the heel region, the midsole includes a strobel upper surface and a strobel sidewall configured to nestingly receive a heel region of the insole. In addition, an interface between the strobel upper surface and the strobel sidewall includes a fillet region configured to support and reduce lateral-medial movement of the insole relative to the midsole.

20 Claims, 6 Drawing Sheets

(51) Int. Cl.

| | |
|---|---|
| ***A43B 13/02*** | (2006.01) |
| ***A43B 17/00*** | (2006.01) |
| ***A43B 7/14*** | (2006.01) |
| ***A43B 17/02*** | (2006.01) |
| ***A43B 17/12*** | (2006.01) |

(52) U.S. Cl.
CPC ..... *A43B 13/125* (2013.01); *A43B 17/00* (2013.01); *A43B 17/02* (2013.01); *A43B 17/12* (2013.01)

(58) Field of Classification Search
USPC ..... 36/100, 101, 10, 55, 30 R, 31, 43, 44
See application file for complete search history.

(56) References Cited

U.S. PATENT DOCUMENTS

| | | | |
|---|---|---|---|
| 6,536,137 | B1 | 3/2003 | Celia |
| 6,618,960 | B2 | 9/2003 | Brown |
| 6,684,532 | B2 | 2/2004 | Greene et al. |
| 6,976,322 | B1 | 12/2005 | Walker |
| 7,197,840 | B2 | 4/2007 | Nakano |
| 7,600,332 | B2 | 10/2009 | Lafortune |
| 8,225,532 | B2 | 7/2012 | Chen |
| 8,266,825 | B2 | 9/2012 | Pfister |
| 8,561,237 | B2 | 10/2013 | Stratten et al. |
| 8,959,798 | B2 | 2/2015 | Pfister |
| 9,021,721 | B2 | 5/2015 | McCarron |
| 9,044,066 | B2 | 6/2015 | Lafortune |
| 9,521,876 | B2 | 12/2016 | Jones et al. |
| 10,172,414 | B2 * | 1/2019 | Hayes ..... A43B 17/02 |
| 2003/0079373 | A1 | 5/2003 | Geer et al. |
| 2003/0093920 | A1 | 5/2003 | Greene et al. |
| 2005/0000117 | A1 | 1/2005 | Polegato Moretti |
| 2005/0022425 | A1 | 2/2005 | Brown |
| 2005/0066544 | A1 | 3/2005 | Beak |
| 2005/0138847 | A1 | 6/2005 | Blackburn et al. |
| 2006/0107553 | A1 | 5/2006 | Clark et al. |
| 2007/0033834 | A1 | 2/2007 | Cheskin et al. |
| 2007/0186446 | A1 | 8/2007 | Lafortune |
| 2008/0040952 | A1 | 2/2008 | Celia |
| 2010/0000127 | A1 | 1/2010 | Feller et al. |
| 2010/0199526 | A1 | 8/2010 | Chen |
| 2011/0061262 | A1 | 3/2011 | Krauss |
| 2011/0113647 | A1 | 5/2011 | Levine |
| 2012/0000092 | A1 | 1/2012 | Ingvarsson et al. |
| 2012/0030965 | A1 | 2/2012 | Greene et al. |
| 2014/0150292 | A1 | 6/2014 | Podhajny et al. |
| 2014/0259778 | A1 | 9/2014 | Anderson |
| 2016/0198794 | A1 | 7/2016 | Wakeland et al. |

OTHER PUBLICATIONS

PCT; International Search Report; dated Nov. 6, 2017; 5 pages, all pages pertinent.

First Examination Report dated Feb. 14, 2020 for co-pending European Patent Application No. 17751554.1, 8 pages.

* cited by examiner

LOCKING MIDSOLE AND INSOLE ASSEMBLY

PRIORITY CLAIM

This patent application is a Continuation of U.S. patent application Ser. No. 15/226,838, entitled "LOCKING MIDSOLE AND INSOLE ASSEMBLY", filed on Aug. 2, 2016, which is hereby incorporated by reference.

FIELD OF THE INVENTION

The present invention is generally directed to a locking insole assembly, and more specifically directed to a footwear midsole and insole closely nested combination, as well as methods of making the same.

BACKGROUND

Conventional footwear items such as, but not limited to, casual shoes are made with an upper, a strobel, a midsole, an outsole, and an insole. Typically, the interconnected upper and strobel unit is attached directly to the midsole. In at least one conventional process for making shoes, the midsole, the outsole, or both are constructed around a "last," which is a foot model that primarily defines the shape and function of the shoe as it is constructed. The last can be curved, semi-curved or straight. The shape of the last is used to shape the footwear and allow proper attachment to the sole.

The insole, which can often be removed, is typically formed and inserted into the shoe as an afterthought. The primary purpose of the stock insole that is typically provided with the shoe is to provide some cushioning and lining over the strobel. Most stock insoles are essentially sock liners. They do not provide heel cupping support or arch support for performance and comfort while standing, walking, or running.

The aftermarket insole and orthotic industry has arisen in view of the shortcomings of stock insoles and sock liners. Many companies offer insoles and orthotics, both custom and off-the-shelf, that attempt to provide more comfort and performance. However, the aftermarket insoles are typically not made by the same company as the footwear manufacturer. The insoles are made to fit a wide selection of shoes and boots. To do so, they must compromise the shape so as to fit in a wide selection of footwear. In view of this, insoles typically do not fit tightly within the shoe and can often be moved in both a lateral-medial direction and a fore-aft (e.g., anterior-posterior) direction relative to the midsole. Due to these compromises, aftermarket insoles do not fit exactly to the midsole, resulting in reduced performance and comfort. Furthermore, the insole, if it is to support the heel and arch without collapsing, has to be constructed with strong materials or increased thicknesses. This can add weight, expense, and can unduly reduce the volume of the footwear.

While some variables such as, but not limited to, foot size, foot width, footwear brand, and general utility (e.g., boots, shoes, sandals, etc.) may guide a consumer, it is readily appreciated that obtaining a "perfect" or even close fitting footwear item can be elusive. Fitting properly in the shoe can also be a problem and can affect the support of the insole or orthotic. Consequently, custom fit orthotics have become more popular as a way to improve the fit and comfort of a footwear item. Even though custom fit orthotics can be molded to closely conform to the person's foot, it may still be a challenge to have the custom fit orthotic adequately fit within a particular footwear item. By way of example, a custom fit orthotic may perform and fit well within a dress shoe, but actually be ill-fitting and even uncomfortable when transferred to a work boot, or vice-versa.

SUMMARY OF THE INVENTION

In at least one aspect of the present invention, a footwear item includes an insole and a midsole. The insole includes an insole top surface, an insole bottom surface, and an insole sidewall. The insole is configured to nest onto the midsole top surface, with the strobel and a portion of the upper between the two. The midsole includes a midsole upper surface and a midsole sidewall configured to receive the insole. An interface between the midsole upper surface and the midsole sidewall includes a fillet region that is sloped and contoured to closely receive the insole so as to provide full support to the insole and to reduce lateral-medial movement of the insole relative to the midsole In another aspect of the present invention, a midsole for a footwear item includes an upper surface, a sidewall, and an interface between the upper surface and the sidewall. The interface is configured to closely receive an insole of the footwear item, wherein the interface is a fillet region configured to provide support and reduce lateral-medial movement of the insole relative to the midsole.

In yet another aspect of the present invention, a method of making a footwear item includes the steps of (1) making an insole with an insole top surface, an insole bottom surface, and an insole sidewall, the sidewall having a heel region; (2) making a midsole; and (3) arranging the insole onto the midsole. The midsole includes a midsole upper surface and a midsole sidewall configured to closely receive the insole. An interface between the midsole upper surface and the midsole sidewall includes a fillet region configured to support the sides of the heel region of the insole.

Preferably, the arch of the midsole is also contoured to nestingly receive the arch of the insole to provide support to the arch region of the insole.

In a further aspect of one preferred embodiment of the invention, at least a portion of the insole is made from a cork material. Preferably, the insole is made from a combination of a cork material and an ethylene vinyl acetate material. The midsole may also be made from a combination of a cork material and an ethylene vinyl acetate material (EVA). In the insole and/or the midsole the cork material may be greater than, less than, or equal to an amount of the ethylene vinyl acetate material by weight, volume or both. Alternatively, the insole and/or the midsole may be constructed of other materials, including EVA, polyurethane, rubber, or other materials or combinations of materials.

In a further aspect of the invention, a strobel and upper is situated between the midsole and the insole. As the fillet region is complementarily shaped with respect to the insole heel region, the strobel and upper follow the contour between the midsole and insole. Thus, in the strobel construction, the shapes of the midsole and/or insole is slightly adjusted to accommodate the strobel/upper between the two. The invention may also be used in a shoe construction that does not employ a strobel. For example, the midsole shape to support the insole can be used with a stitch-down construction where the midsole is shaped to receive the matching insole shape, giving the full, complete support to the insole.

BRIEF DESCRIPTION OF THE DRAWINGS

Preferred and alternative embodiments of the present invention are described in detail below with reference to the following drawings.

DETAILED DESCRIPTION

In the following description, certain specific details are set forth in order to provide a thorough understanding of various embodiments of the invention. However, one skilled in the art will understand that the invention may be practiced without these details. In other instances, well-known structures associated with footwear, insoles, midsoles, non-removable soles, footbeds, shanks, orthotics, cushioning devices, heel stabilizers, other stability devices, various types of last members or constructions (e.g., board lasted, slip lasted, Strobel lasted, combination lasted, etc.), combinations thereof, and methods of making the same, have not necessarily been shown or described in detail to avoid unnecessarily obscuring descriptions of the embodiments of the invention.

Examples of footwear items, orthotics, or both can be found in U.S. Pat. Nos. 6,618,960 and 6,976,322, which are incorporated herein by reference in their entireties. Additionally or alternatively, other examples of the footwear items, orthotics, or both can be found in U.S. Patent Publication No. 2016/0198794, which is incorporated herein by reference in its entirety.

The present invention provides a locking insole assembly that includes an insole and a midsole according to at least one embodiment of the present invention. The midsole may help fill in the gaps or "fitting" differences as between an insole and a midsole. In at least one embodiment, the footwear item is constructed around the insole, and the midsole is configured to address the gaps or fitting issues between the insole and the midsole. The midsole, by closely fitting the contour of the sides of the heel cup of the insole, also supports the insole from collapse, thus aiding in supporting the wearer's foot. Additionally, the locking insole assembly may include a cork-based insole that is adaptive to a person's foot, but allows the footwear item to be generically produced for a same-sized foot because the midsole cooperates with the insole to provide support. Such support, for example, helps retain the heel cup in place to properly cup the heel of the wearer, even with the more conforming, comfortable cork-based material of which the heel cup is made. Additionally or alternatively, the midsole may permit a toe region the person's foot to move by at least a small distance (e.g., about five millimeters or less) in a fore-aft (e.g., anterior-posterior) direction while maintaining the heel in place or in a relatively neutral position.

Figure 1:
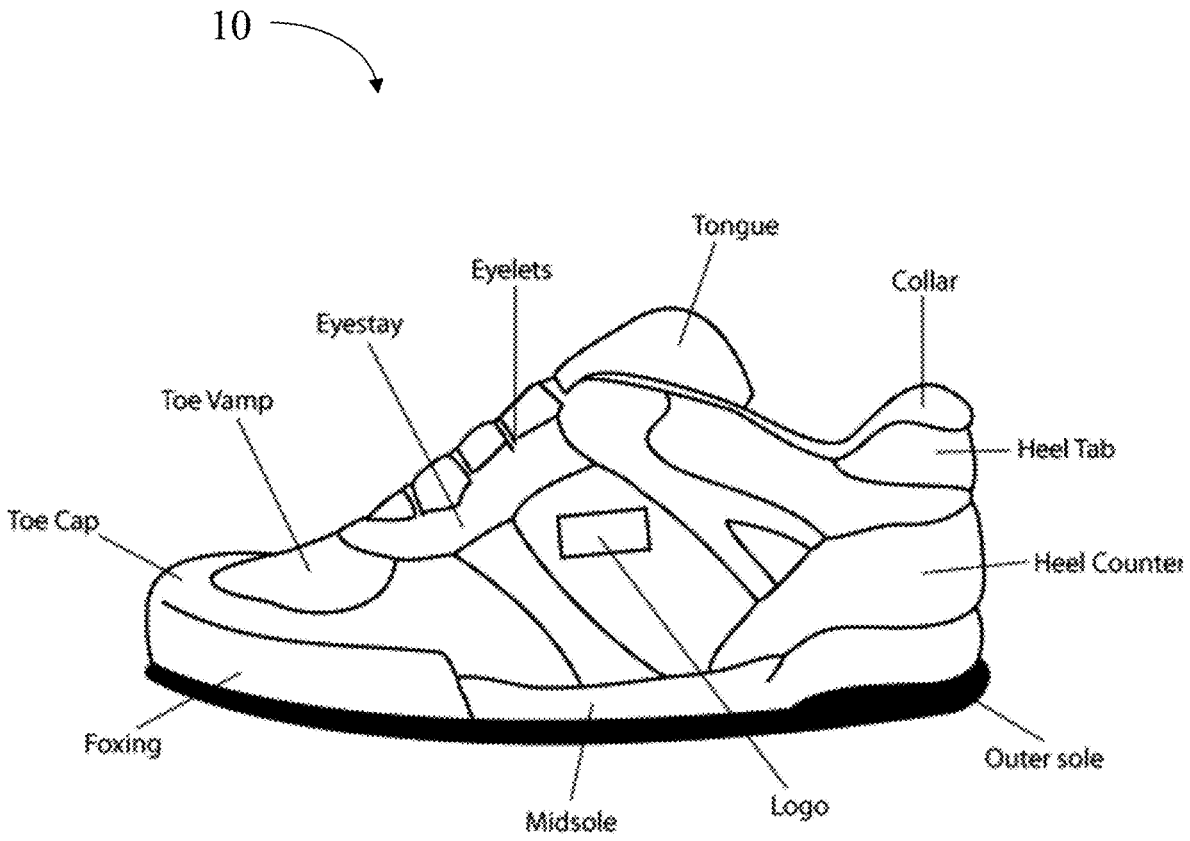
FIG. 1 (Prior Art)
FIG. 1 is a side-elevational view of a prior-art footwear item.

FIG. 1 shows a footwear item 10 with the typical components labeled in the drawing. In the illustrated footwear item 10, an insole (not shown) rests on top of the midsole and strobel/upper combination, and generally provides some amount of support and cushioning for the wearer.

Figure 2:
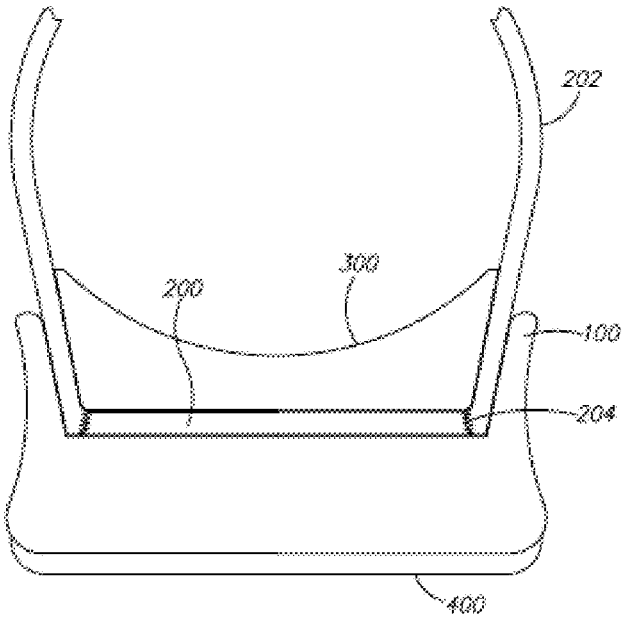
FIG. 2 is a cross-sectional view of a footwear item according to an embodiment of the present invention.

FIG. 2 shows a cross-sectional view of a footwear item having a midsole 100, a strobel 200, an upper 202, an insole 300, and an outsole 400. The strobel 200 is typically a flat component coupled to the upper 202 by stitches 204 or other attachment means. A periphery contour of the insole 300 and an inner surface of the midsole 100 are complementarily shaped such that the insole 300 can be closely received and laterally constrained by the midsole 100, with the strobel/upper in between. These complementary surfaces permit the insole 300 to closely nest and lateral lock relative to the midsole 100. In this tight configuration of the midsole and insole, the midsole also provides lateral support to at least the heel region of the insole, such that the insole retains good cupping for the heel. It may also support the arch region of the insole to keep it from excessively collapsing.

Figure 3:
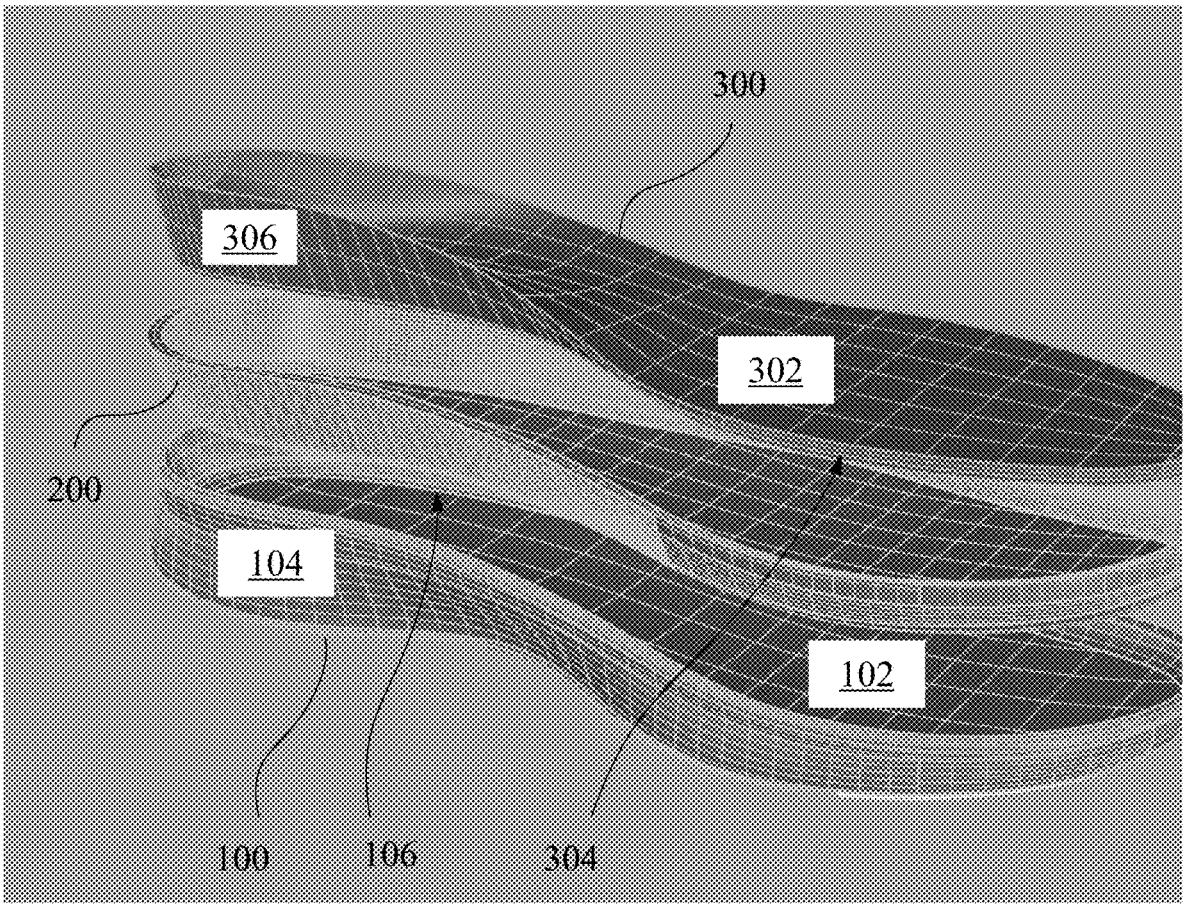
FIG. 3 is an exploded, isometric, top view of an insole, a strobel/upper, and a midsole according to an embodiment of the present invention.
Figure 4:
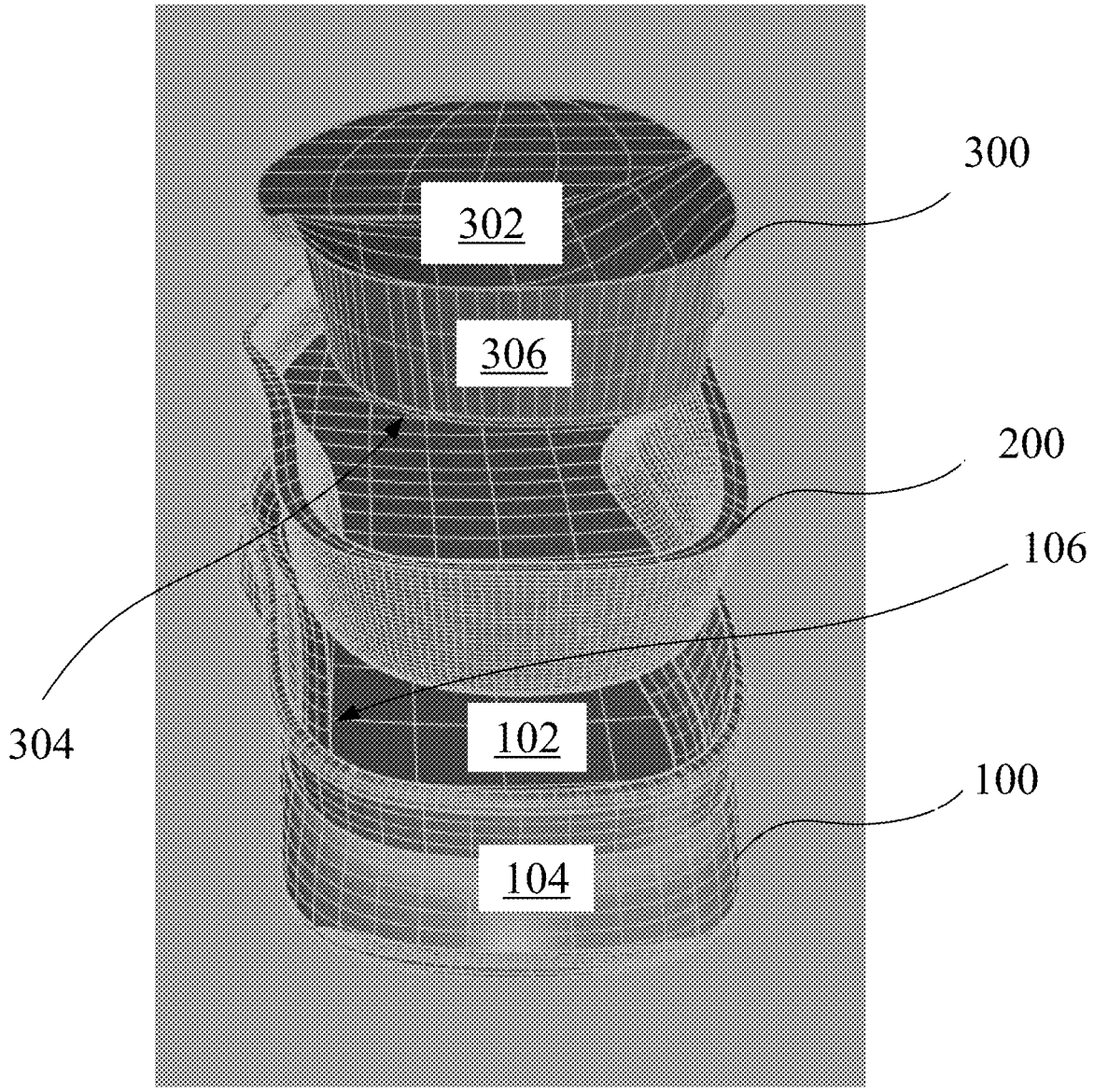
FIG. 4 is an exploded, rear elevational view of the insole, the strobel/upper, and the midsole of FIG. 3 according to an embodiment of the present invention.
Figure 5:
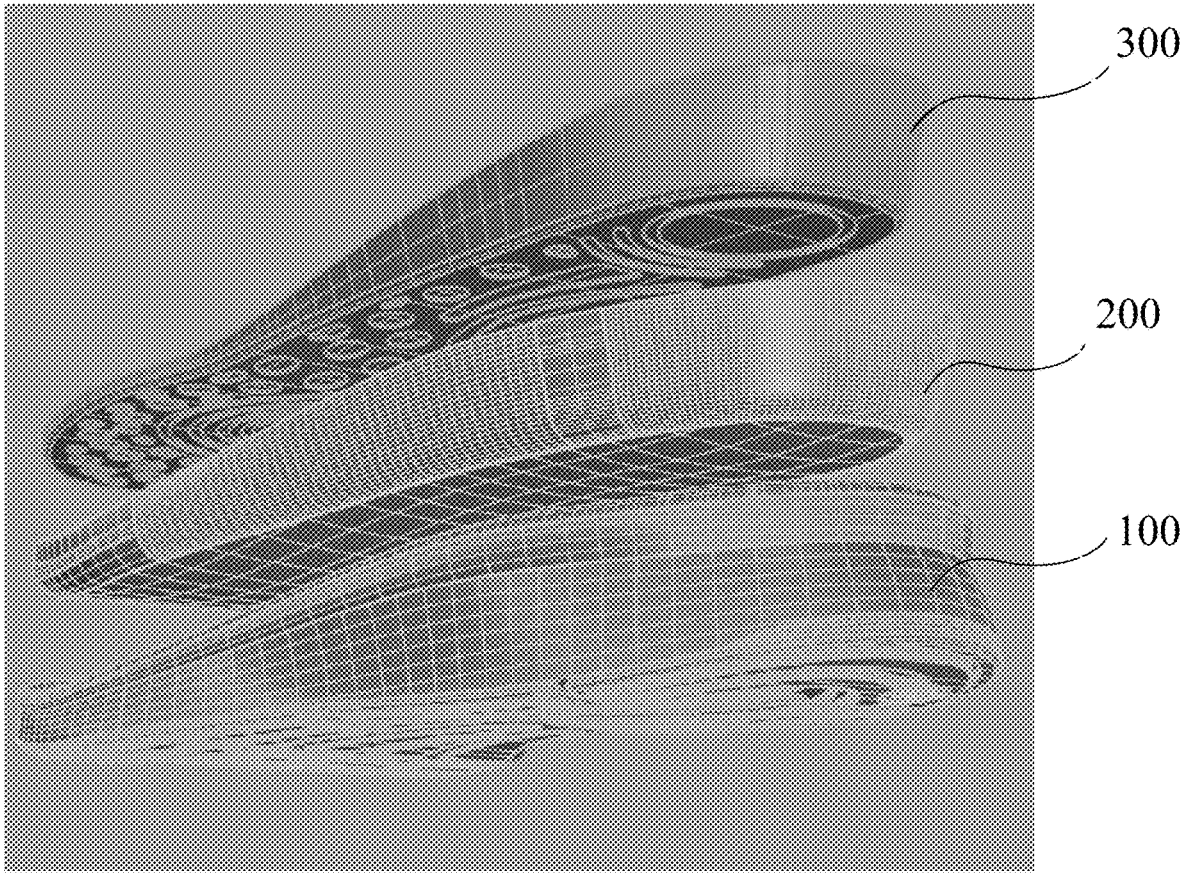
FIG. 5 is an exploded, isometric, bottom view of the insole, the strobel/upper, and the midsole of FIG. 3 according to an embodiment of the present invention.

FIGS. 3-5 show various exploded views of the midsole and outsole 100, the strobel/upper 200, and the insole 300, which may form the basis for a footwear item according to an embodiment of the present invention. Note that the strobel/upper representation in these figures includes the lower portion (strobel) stitched to the lower edges of the upper (as shown in FIG. 1). In FIGS. 3-5, the upper is shown cut off above the small lateral region illustrated, but in actual footwear the upper continues up and over the foot of the wearer. FIG. 3 shows an exploded, isometric, top view of the midsole/outsole 100, the strobel/upper 200 and the insole 300. Note that, when assembled, the strobel/upper is fixed to the midsole/outsole, while the insole is preferably not fixed to the strobel/upper, but closely nests therein. FIG. 4 shows an exploded, rear view of the midsole/outsole 100, the strobel/upper 200 and the insole 300. FIG. 5 shows an exploded, isometric, bottom view of the midsole/outsole 100, the strobel/upper 200 and the insole 300.

In at least one embodiment, the midsole is made from a standard midsole material such as, but not limited to, an EVA material. In alternate embodiments, other materials may be used.

In at least one embodiment, the insole 300 is made from a cork material. In another embodiment, the insole 300 is made from a combination of a cork material and an EVA material. The amount of the cork material may be greater than, lesser than, or equal to the amount of the EVA material by weight, volume, or both. The insole 300 includes an insole top surface 302, an insole bottom surface 304, and an insole sidewall 306.

The strobel/upper 200 is positioned between the insole 300 and the midsole 100. In at least one embodiment, the midsole 100 can be made from a combination of a cork material and an EVA material. The amount of the cork material may be greater than, lesser than, or equal to the amount of the EVA material by weight, volume, or both.

The midsole 100 includes a midsole upper surface 102 and a midsole sidewall 104 that form an interface 106 configured to nestingly receive the insole 300. The interface 106 is at least partially formed by a fillet region. As discussed above, a shoe is generally constructed around a "last" and not constructed around an insole. However, in the present invention, the midsole 100 is purposefully constructed around or in view of the insole 300. By way of example, the fillet region 106 is formed to closely nest and securely cup, hold, support, constrain or lock the heel region of the insole 300. Thus, the fillet region 106 and the insole sidewall 306 are constructed to have a close (e.g., locking-type) fit, especially in the heel region of the insole. Thus, the midsole helps support the cupping shape of the heel region of the insole to provide consistent support for the heel of the foot of the wearer.

The fillet region 106 is complementarily shaped with respect to the insole sidewall 306 to reduce lateral-medial movement of the insole 300 relative to the midsole 100 and to support the heel, as discussed above. Nevertheless, the insole 300 may be moveable or stretchable in the toe region relative to the midsole 100. The moving or stretching of the insole 300 relative to the midsole 100 may occur primarily in a posterior-anterior direction. By way of example, a toe region of the insole 300 may be adequately flexible to move or stretch relative to the midsole 100 by an amount of less than or equal to about five millimeters, while a heel portion of the insole 300 remains relatively locked with respect to the midsole 100. The toe region of the insole 300 may not lay flat on the strobel 200 because the insole 300 is flexible after molding and conforms to the toe region of the midsole 100 after being worn or "broken-in" by a wearer.

Figure 6:
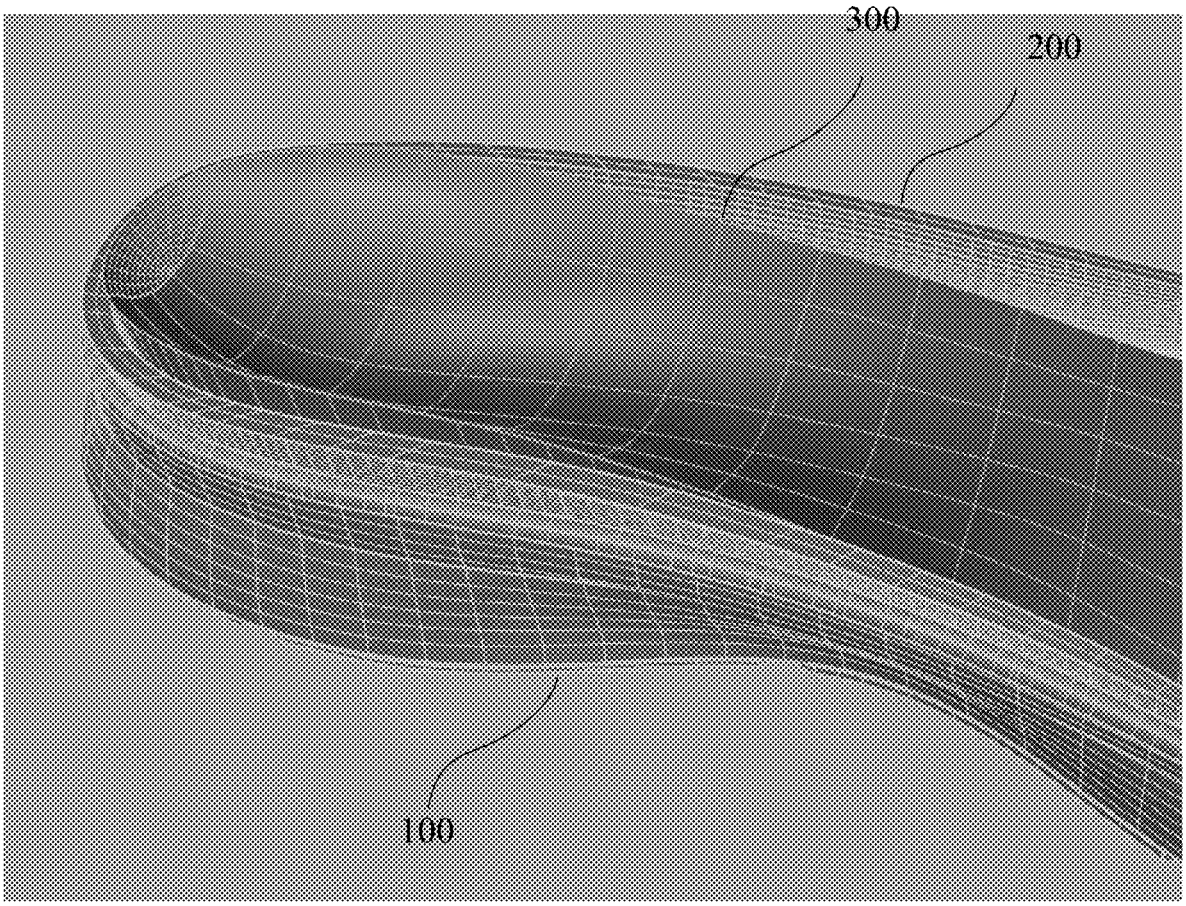
FIG. 6 is a close-up, assembled, isometric view of the insole, the strobel/upper, and the midsole of FIG. 3 according to an embodiment of the present invention.

FIG. 6 shows a perspective, assembled view of the insole 300 nested in the midsole 100 with the strobel 200 located between. The strobel/upper conforms to the shapes of the midsole 100, as the strobel/upper is typically flexible and somewhat uniform in thickness. The midsole thus provides the contour to match the insole, offset slightly by the thickness of the strobel/upper. The matching contour provides support to the insole and holds it in place. As noted above, the midsole is affixed to the strobel/upper 200. Such affixation may be with an adhesive. The insole 300 may also be fixed to the strobel/upper 200, but is preferably not fixed. As noted, the toe end of the insole is preferably allowed to move slightly fore and aft during use.

While preferred embodiments of the invention have been illustrated and described, as noted above, many changes can be made without departing from the spirit and scope of the invention. In addition, other advantages will also be apparent to those of skill in the art with respect to any of the above-described embodiments whether viewed individually or in some combination thereof. Accordingly, the scope of the invention is not limited by the disclosure of the preferred embodiment. Instead, the invention should be determined entirely by reference to the claims that follow.

What is claimed as new and desired to be protected by Letters Patent of the United States is:

1. A footwear item comprising:

an insole having a heel region with a top surface, a bottom surface, and a sidewall, the insole sidewall having a periphery contour; and a midsole having a toe region and a heel region with a midsole upper surface and a midsole sidewall, the midsole sidewall having an inner surface with a shape that inversely matches the periphery contour of the insole sidewall of the insole heel region prior to receiving the insole, the inversely matched inner surface of the midsole heel region sloping inward from top to bottom, the inversely matched inner surface of the midsole heel region being configured to nestingly receive at least the insole heel region and to laterally lock the insole relative to the midsole, wherein an interface between a heel region of the midsole upper surface and the midsole sidewall is configured to closely receive and support the insole heel region and reduce lateral-medial movement of the insole heel region relative to the midsole.

2. The footwear item of claim 1, wherein at least a portion of the insole is made from a cork material.

3. The footwear item of claim 1, wherein the insole is made from a combination of a cork material and an ethylene vinyl acetate material.

4. The footwear item of claim 1, further comprising a strobel and upper between the midsole and the insole, wherein the interface between the heel region of the midsole upper surface and the midsole sidewall is complementarily shaped with respect to the insole heel region, the strobel and upper following the contour between the midsole and insole.

5. The footwear item of claim 1, wherein the midsole is made from a combination of a cork material and an ethylene vinyl acetate material.

6. The footwear item of claim 1, wherein the midsole is configured to matingly receive the insole along a majority of the length of the insole.

7. The footwear item of claim 1, wherein the insole has a toe region that includes a flexible material.

8. The footwear item of claim 1, wherein an arch region of the midsole is contoured to nestingly receive an arch region of the insole to provide support to the insole arch region.

9. The footwear item of claim 1, further comprising an upper disposed between the midsole and the insole, the upper having a heel region with a sidewall, the upper sidewall having a lower portion, the lower portion of the upper sidewall being fixed to the midsole and following the complementarily shaped inner surface of the midsole heel region, the insole being spaced apart from the midsole heel region by at least the lower portion of the upper sidewall when the insole is nestingly received and laterally locked relative to the midsole.

10. The footwear item of claim 1, wherein the midsole sidewall of the midsole heel region has a top edge, the top surface of the insole heel region has a central portion, a medial portion, and a lateral portion, and, after at least the insole heel region is nestingly received in the midsole heel region, the central portion of the insole heel region is disposed below the top edge of the midsole sidewall of the midsole heel region and one or more of the medial portion or the lateral portion of the top surface of the insole heel region are disposed above the top edge of the midsole sidewall of the midsole heel region.

11. A footwear item comprising:

an insole having a heel region with a top surface, a bottom surface, and a sidewall, the insole sidewall having a periphery contour; and a midsole having a toe region and a heel region, the midsole heel region comprising:

an upper surface;

a sidewall that slopes inward from top to bottom; and an interface between the upper surface and the sidewall, the interface being shaped to inversely match the insole sidewall of the insole heel region, prior to receiving the insole, to nestingly and closely receive a heel region of the insole of the footwear item and to laterally lock the insole of the footwear item relative to the midsole.

12. The footwear item of claim 11, wherein the midsole is made from a combination of a cork material and an ethylene vinyl acetate material.

13. The footwear item of claim 12, wherein an amount of the cork material is greater than or less than an amount of the ethylene vinyl acetate material by weight, volume or both.

14. A method of making a footwear item, the method comprising:

making an insole with a heel region having an insole top surface, an insole bottom surface and an insole sidewall, the insole sidewall of the insole heel region having a periphery contour;

making a midsole with a toe region and a heel region having a midsole upper surface and a midsole sidewall, the midsole sidewall having an inner surface that slopes inward from top to bottom, wherein an interface between the midsole upper surface and the midsole sidewall is shaped to inversely match the periphery contour of the insole sidewall of the insole heel region prior to receiving the insole; and arranging the insole onto the midsole to nestingly and closely receive the insole heel region in the midsole heel region and to laterally lock the insole heel region relative to the midsole.

15. The method of claim 14, wherein making the insole includes making at least a portion of the insole from a cork material.

16. The method of claim 14, wherein making the insole includes making at least a portion from a combination of a cork material and an ethylene vinyl acetate material.

17. The method of claim 14, wherein making the midsole includes shaping the interface between the midsole upper surface and the midsole sidewall to be complementarily shaped with respect to the insole.

18. The method of claim 14, wherein making the midsole includes making the midsole from a combination of a cork material and an ethylene vinyl acetate material.

19. The method of claim 18, wherein an amount of the cork material is greater than or less than an amount of the ethylene vinyl acetate material by weight, volume or both.

20. The method of claim 14, further comprising making a toe region of the insole with a flexible material.

* * * * *